US010496115B2

(12) United States Patent
Hung et al.

(10) Patent No.: US 10,496,115 B2
(45) Date of Patent: Dec. 3, 2019

(54) FAST TRANSIENT RESPONSE VOLTAGE REGULATOR WITH PREDICTIVE LOADING

(71) Applicant: MACRONIX INTERNATIONAL CO., LTD., Hsinchu (TW)

(72) Inventors: Chun-Hsiung Hung, Hsinchu (TW); Shang-Chi Yang, Changhua (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 0 days.

(21) Appl. No.: 15/641,167

(22) Filed: Jul. 3, 2017

(65) Prior Publication Data

US 2019/0004552 A1 Jan. 3, 2019

(51) Int. Cl.

| | |
|---|---|
| ***G05F 1/00*** | (2006.01) |
| ***G05F 1/565*** | (2006.01) |
| ***G05F 1/56*** | (2006.01) |
| ***G05F 1/575*** | (2006.01) |
| ***G05F 1/46*** | (2006.01) |

(52) U.S. Cl.

CPC ..... *G05F 1/565* (2013.01); *G05F 1/462* (2013.01); *G05F 1/56* (2013.01); *G05F 1/575* (2013.01)

(58) Field of Classification Search

CPC ..... G05F 1/461; G05F 1/575; G05F 1/56; H02M 3/156; H02M 3/158; H02M 3/1588; H02M 3/155; H02M 3/1582; H02M 2003/1557

See application file for complete search history.

(56) References Cited

U.S. PATENT DOCUMENTS 5,512,831 A 4/1996 Cisar et al.
5,831,566 A 11/1998 Ginetti
(Continued)

FOREIGN PATENT DOCUMENTS

CN 101345288 A 1/2009
CN 102541134 A 7/2012
(Continued)

OTHER PUBLICATIONS

"Low-dropout regulator," https://en.wikipedia.org/wiki/Low-dropout_regulator?oldid=767916335; Feb. 28, 2017, 5 pages.
(Continued)

*Primary Examiner* — Adolf D Berhane
*Assistant Examiner* — Afework S Demisse
(74) *Attorney, Agent, or Firm* — Haynes Beffel & Wolfeld LLP

(57) ABSTRACT

A circuit and a method for supplying a regulated voltage to a target circuit characterized by fast changes in current loading are described. A voltage regulator supplies the regulated voltage to an output node. A current loading circuit is connected to the output node of the voltage regulator. Logic causes the current loading circuit to apply a current load to the output node during a pre-loading interval starting in advance of an event that increases current loading in the target circuit and ending upon occurrence of the event. Logic is included to cause the current loading circuit to apply a current load to the output node during a post-loading interval starting upon occurrence of an event that decreases current loading in the target circuit.

15 Claims, 3 Drawing Sheets

(56) References Cited

U.S. PATENT DOCUMENTS

| | | | | |
|---|---|---|---|---|
| 5,852,360 | A | 12/1998 | Levinson | |
| 5,894,281 | A | 4/1999 | Toda | |
| 6,188,212 | B1 | 2/2001 | Larson et al. | |
| 6,246,221 | B1 | 6/2001 | Xi | |
| 6,600,299 | B2 | 7/2003 | Xi et al. | |
| 7,282,902 | B2 | 10/2007 | Chang et al. | |
| 7,283,082 | B1 | 10/2007 | Kuyel | |
| 7,397,226 | B1 | 7/2008 | Mannama et al. | |
| 7,551,112 | B2 | 6/2009 | Choi et al. | |
| 7,573,411 | B2 | 8/2009 | Shin et al. | |
| 7,928,871 | B2 | 4/2011 | Aruga et al. | |
| 8,054,302 | B2 | 11/2011 | Kim et al. | |
| 8,063,805 | B1 * | 11/2011 | Eid | G05F 1/56 341/142 |
| 8,089,261 | B2 | 1/2012 | Lipka | |
| 8,618,971 | B1 | 12/2013 | Li | |
| 8,710,813 | B2 | 4/2014 | Yang et al. | |
| 8,760,131 | B2 | 6/2014 | van Ettinger et al. | |
| 9,053,814 | B2 | 6/2015 | Lee | |
| 9,069,370 | B2 | 6/2015 | Soenen et al. | |
| 9,170,592 | B2 | 10/2015 | Seymour et al. | |
| 9,239,584 | B2 | 1/2016 | Lerner et al. | |
| 9,261,892 | B2 | 2/2016 | Wang et al. | |
| 9,310,816 | B2 | 4/2016 | Chang et al. | |
| 9,471,078 | B1 | 10/2016 | Guan et al. | |
| 9,553,548 | B2 | 1/2017 | Park et al. | |
| 9,825,644 | B2 | 11/2017 | Kim | |
| 9,857,815 | B2 | 1/2018 | Caracciolo | |
| 2006/0012932 | A1 | 1/2006 | Kitagawa | |
| 2006/0176032 | A1 | 8/2006 | Malherbe et al. | |
| 2006/0224337 | A1 | 10/2006 | Hazucha et al. | |
| 2007/0171106 | A1 | 7/2007 | Bingel et al. | |
| 2008/0180082 | A1 | 7/2008 | Fan | |
| 2010/0026251 | A1 | 2/2010 | Lam et al. | |
| 2010/0079210 | A1 | 4/2010 | Yamauchi et al. | |
| 2010/0237839 | A1 | 9/2010 | Gurcan | |
| 2011/0121802 | A1 * | 5/2011 | Zhu | G05F 1/575 323/281 |
| 2012/0306506 | A1 | 12/2012 | Kiuchi | |
| 2013/0119954 | A1 | 5/2013 | Lo | |
| 2014/0084881 | A1 | 3/2014 | Shih et al. | |
| 2014/0340067 | A1 | 11/2014 | Zhong et al. | |
| 2015/0035505 | A1 | 2/2015 | Peluso | |
| 2016/0173066 | A1 * | 6/2016 | Yang | H03K 19/0013 327/109 |
| 2017/0077808 | A1 | 3/2017 | Iwai et al. | |
| 2017/0285675 | A1 | 10/2017 | Gao et al. | |

FOREIGN PATENT DOCUMENTS

| | | | |
|---|---|---|---|
| DE | 202012011893 | U1 | 1/2013 |
| EP | 899645 | A2 | 3/1999 |
| TW | 201418926 | A | 5/2014 |

OTHER PUBLICATIONS

"Operational Amplifier," https://en.wikipedia.org/wiki/Operational_amplifier, downloaded on May 1, 2017, 22 pages.

Sanchez-Sinencio, "Low Drop-Out (LDO) Linear Regulators: Design Considerations and Trends for High Power-Supply Rejection (PSR)," IEEE Santa Clara Valley Solid Circuits Society, Feb. 11, 2010, 47 pages.

Zumbahlen, The Linear Circuit Design Handbook, Chapter 1, Analog Devices, Inc., Mar. 13, 2008, 104 pages.

Office Action in U.S. Appl. No. 15/658,286 dated Feb. 23, 2018, 8 pages.

U.S. Office Action in U.S. Appl. No. 15/673,644 dated Mar. 12, 2018, 8 pages.

EP Extended Search Report from EP 17183508.5 dated Apr. 20, 2018, 10 pages.

Rohm Semiconductor: "White Paper CMOS LDO 1-15 Regulators for portable devices," Jan. 1, 1999, 10 pages.

U.S. Notice of Allowance in U.S. Appl. No. 15/658,745 dated Jul. 16, 2018, 7 pages.

U.S. Office Action in U.S. Appl. No. 15/658,286 dated Sep. 7, 2018, 10 pages.

U.S. Office Action in U.S. Appl. No. 15/658,286 dated Mar. 22, 2019, 8 pages.

U.S. Office Action in U.S. Appl. No. 15/673,644 dated Apr. 15, 2019, 10 pages.

U.S. Office Action in U.S. Appl. No. 15/673,644 dated Jan. 31, 2019, 12 pages.

* cited by examiner

10mA/100nsec

FAST TRANSIENT RESPONSE VOLTAGE REGULATOR WITH PREDICTIVE LOADING

BACKGROUND

Technical Field

The present invention relates to voltage regulators, including voltage regulators used in integrated circuits having rapidly changing loads.

Description of Related Art

Voltage regulators are utilized in integrated circuit design to provide a supply voltage to internal circuitry that can be more stable than an external power supply.

In integrated circuits having rapidly changing loads, the transient response of the voltage regulators can be a limiting property. If the current load of the target circuit changes rapidly, such as on the order of the transient response of the voltage regulator, then the regulated voltage provided can spike, overshoot, undershoot or fluctuate during the transition. These spikes or fluctuations can limit the effectiveness of the target circuit.

For example, a voltage regulator, in a class of regulators known as low dropout LDO voltage regulators, comprises a power MOSFET that is connected between an external power supply and the output node of the regulator. The gate of the power MOSFET is driven by an amplifier with a feedback loop to maintain constant voltage on the output node. The power MOSFET can be very large, and have a large gate capacitance. This large gate capacitance increases the time constant of the feedback loop, and makes the transient response of a typical LDO relatively slow compared to nanosecond scale switching in electronic circuits. As a result, a target circuit can be exposed to spikes or fluctuations in the regulated voltage during events that cause a change in current loading by the target circuit.

It is desirable to provide a voltage regulator suitable for use in integrated circuits, with a stable output voltage during fast transitions in current loading in a target circuit.

SUMMARY

A circuit and a method are described for supplying a regulated voltage to a target circuit characterized by fast changes in current loading. Circuits described herein include a voltage regulator to supply the regulated voltage to an output node, a current loading circuit connected to the output node of the voltage regulator, such as an LDO voltage regulator, and logic to cause the current loading circuit to apply a current load to the output node during a pre-loading interval starting in advance of an event that increases current loading in the target circuit and ending upon occurrence of the event. As a result, the magnitude of the current loading transition upon the fast change in current loading by the target circuit is reduced, and the fluctuations in the regulated voltage are reduced.

In some embodiments, logic is included to cause the current loading circuit to apply a current load to the output node during a post-loading interval starting upon occurrence of an event that decreases current loading in the target circuit.

Thus, for example, an integrated circuit can include circuits such as state machines or processors that perform logic operations having predictable mode changes that cause rapid increases and decreases in current loading on the voltage regulator. The current loading circuit in a circuit as described herein can be enabled to apply current loading during the pre-loading interval and during the post-loading interval so that transitions in current loading upon occurrence of an event in the mode change are reduced or eliminated As a result of the operation of the current loading circuit, the output current waveform driven by the voltage regulator is reshaped according to mode changes in the target circuit in a way that reduces the magnitude of current load transitions, and significantly reduces spikes and fluctuations in the regulated voltage.

A method for supplying a regulated voltage to a target circuit characterized by fast changes in current loading is also described. The method includes applying regulated voltage on an output node coupled to the target circuit, and applying a current load to the output node during a pre-loading interval starting in advance of the event that increases current loading in the target circuit and ending upon occurrence of the event. Also, in some embodiments, the method includes applying a current load to the output node during a post-loading interval starting upon occurrence of an event that decreases current loading in the target circuit, and ending thereafter.

Other aspects and advantages of the present technology can be seen on review of the drawings, the detailed description and the claims, which follow.

DETAILED DESCRIPTION

A detailed description of embodiments of the present invention is provided with reference to the FIGS. 1-4.

Figure 1:
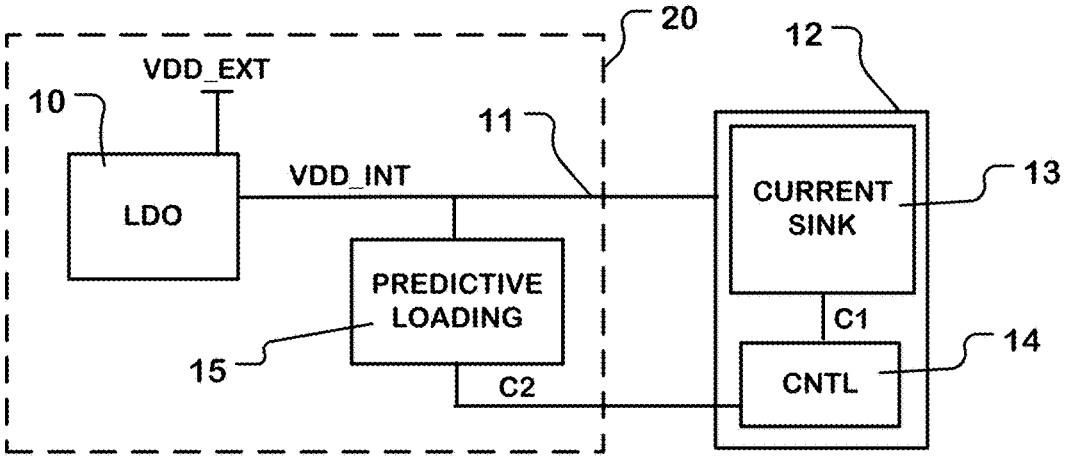
FIG. 1 is a simplified block diagram of a device including a fast transient response voltage regulator with predictive loading as described herein.

FIG. 1 illustrates a circuit 20 connected to a target circuit 12. The circuit 20 includes a voltage regulator 10, such as an LDO voltage regulator, and predictive loading circuits 15. The circuit 20 supplies a regulated voltage VDD_INT generated by the voltage regulator 10 as an internal supply voltage on an output node 11 to the target circuit 12. The target circuit 12 includes a current sink 13 and control logic 14. The control logic 14 can supply a mode change signal C1 to the current sink 13 which causes a fast change in current loading by the target circuit 12. Also, the control logic 14 can supply a signal C2 to predictive loading circuits 15. Although as illustrated, the signal C2 is provided by the control logic 14 in the target circuit, in other configurations, logic outside the target circuit can produce the signal C2.

In one example, the target circuit 12 comprises an integrated circuit memory. The target circuit 12 can comprise a variety of circuits other than integrated circuit memory.

In the integrated circuit memory example, the current sink 13 includes a memory array and peripheral circuits used during operation of the memory array. The control logic 14 can include a state machine or other logic circuitry used to change the operating modes of the memory. For example, the memory can include a page read mode with error correction. A transition in mode change signal C2 can be an event indicating a beginning of a page read operation. A transition in signal C1 can be an event indicating the timing of a predicted transition in which there is a fast increase in current loading during the read operation. For example, during a page read operation with error correction, it can be predicted that there will be a rapid increase in current loading when error correction operations are initiated as the data is retrieved from the memory array. By way of example, the increase in current loading can occur on a nanosecond scale as the error correction circuits are engaged to process a page of data retrieved from the memory. A corresponding decrease in current loading can occur when the error correction operation completes. Another transition in signal C1 can be an event indicating the timing of a predicted transition in which there is a fast decrease in current loading during the read operation.

Figure 2:
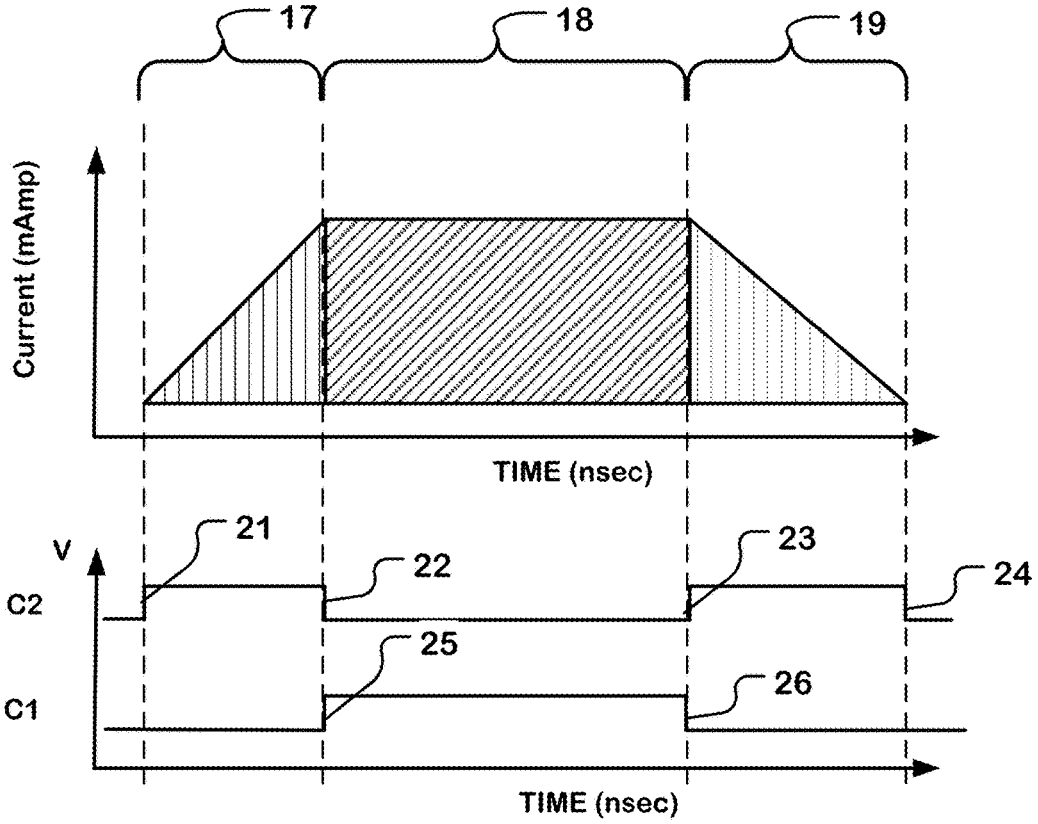
FIG. 2 is a timing diagram referred to for the purposes of describing the method of operating a device like that of FIG. 1.

FIG. 2 is a timing diagram referred to for the purposes of describing operation of the circuit of FIG. 1. FIG. 2 is a graph of current versus time showing the total current driven by the voltage regulator on line 11 caused by current loading in the target circuit combined with current loading in the predictive loading circuits 15. Also in FIG. 2, the timing of transitions in the control signals C1 and C2 are illustrated.

In this simplified example, the control signal C2 has transitions 21, 22 defining a pre-loading interval 17 and transitions 23, 24 defining a post-loading interval 19. The control signal C1 has transitions 25, 26 corresponding to a first event that increases current loading in the target circuit and corresponding to a second event that decreases current loading in the target circuit, where the time between transitions 25 and 26 defines an operating interval 18 in this example.

In operation, while the voltage regulator supplies the regulated voltage on the output node 11 coupled to the target circuit, a current load is applied to the output node by the predictive loading circuits 15 during the pre-loading interval 17 starting at transition 21 in this example in advance of the event (transition 25 in this example) that increases current loading in the target circuit, and ending upon occurrence of the event (at transition 25 in this example). Upon occurrence of the event, the current loading represented by the rapid increase changes over from the current loading circuit to the target circuit without a large rapid change in magnitude of the current load on the voltage regulator.

As shown in the graph of current versus time, the current load applied by the predictive loading circuits 15 increases in a linear ramp from an initial level to an ending level, which is the maximum level in this example. The linear ramp can monotonically increase with a slope compatible with the transient response of the voltage regulator in the sense during the pre-loading interval 17. The shape of the magnitude curve for the current loading applied in the pre-loading interval 17 can have other shapes, besides the linear ramp. For example, a stepped shape, or a convex ramp or concave ramp shape can be used, preferably having a rate of change that compatible with the transient response of the voltage regulator to reduce or prevent spikes or fluctuations in the regulated voltage.

The magnitude of the current load at the end of the pre-loading interval can match the level of the current loading that is specified or typical of the operating mode of the target circuit during or at the initiation of the operating interval 18. In this manner, the magnitude change at transition 25 caused by the changeover in current loading can be minimized or eliminated.

At the transition 25 corresponding to the rapid increase in current loading in the target circuit, the pre-loading interval ends and the current applied by the predictive loading circuits 15 is turned off or rapidly reduced. In this manner, the peak load encountered by the voltage regulator does not substantially increase beyond the peak load required by the target circuit, and rapid changes in current loading upon occurrence of the mode change are eliminated or reduced in magnitude.

Also in operation, the voltage regulator supplies the regulated voltage on the output node 11 during the operating interval 18. At the end of the operating interval 18, a current load is applied to the output node by the predictive loading circuits 15 during the post-loading interval 19 starting at the event represented by transition 23 in the control signal which is synchronized in this example with the event represented by transition 26 in the timing diagram at which the current loading rapidly decreases in the target circuit. The post-loading interval 19 ends thereafter at transition 24 in this example, having a duration that depends on the transient response of the voltage regulator and on operation of the current loading circuits to reduce the current loading to a level in which the target circuit is idle or consuming low current levels.

As shown in the graph of current versus time, the current load applied by the predictive loading circuits 15 decreases monotonically in the linear ramp from the maximum level, or starting level of the linear ramp, to an ending level which is the minimum level in this example. The linear ramp can have a negative slope which is compatible with the transient response of the voltage regulator, so that the regulated voltage remains substantially constant during the post-loading interval 19. The magnitude of the current load during the post-loading interval at the beginning can match the level of current loading that is specified or typical for the operating mode of the target circuit during or at the termination of the operating interval 18. In this manner, the magnitude change at transition 26 caused by the changeover in current loading can be minimized or eliminated.

At the transition 26, corresponding to the rapid decrease in current loading in the target circuit, the post-loading interval starts and the current applied by the predictive loading circuits 15 is turned on or rapidly increased. In this manner, the peak load encountered by the voltage regulator does not substantially increase beyond the peak load required by the target circuit, and rapid changes in current loading upon occurrence of the mode change are eliminated or reduced in magnitude.

Figure 3:
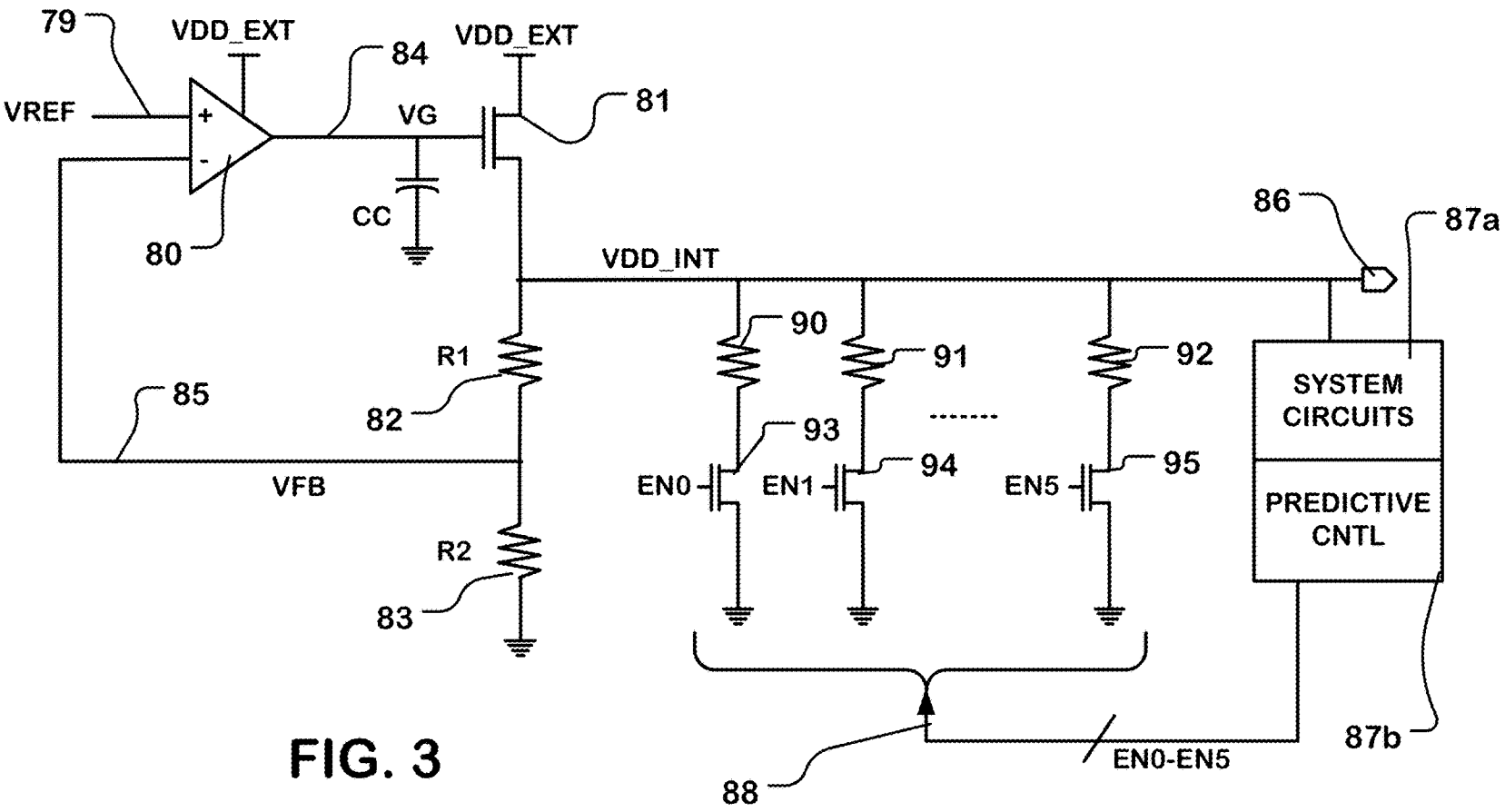
FIG. 3 is a circuit diagram of a device including a fast transient response LDO voltage regulator and current loading circuit as described herein.

FIG. 3 is a circuit diagram of an embodiment of a voltage regulator with fast transient response according to the technology described herein. The circuit in FIG. 3 includes an LDO voltage regulator that comprises an operational amplifier 80 coupled to an external power supply VDD_EXT, a transistor 81, which is an n-channel power MOSFET in this example, having a drain coupled to the external power supply VDD_EXT and having a source coupled to the output node 86. The operational amplifier 80 supplies a gate voltage VG on line 84 to the gate of transistor 81. A feedback circuit is coupled between the output node and the "–" input of the operational amplifier. A voltage reference supplies VREF on line 79 to the "+" input of the operational amplifier. The voltage reference can be a bandgap reference.

The feedback circuit in this example includes resistors 82 and 83 in series between the output node 86 and ground, and connector 85 connecting a node between resistors 82 and 83, at which a feedback voltage VFB is generated, to the "–" input. The resistors 82, 83 have values R1 and R2 which can be set to determine the level of the internal supply voltage VDD_INT generated on the output node 86.

The transistor 81 has a gate capacitance, represented in FIG. 3 by the capacitor symbol CC. In this circuit, the capacitance CC may not include a separate capacitor. The gate capacitance can be large in some embodiments, resulting in longer time constants for the feedback loop, and slower transient responses at the output node.

The output node 86 supplies the power supply voltage VDD_INT, and is connected to a target circuit, which can include system circuits 87*a* for an integrated circuit which are powered by VDD_INT. Predictive control 87*b* can also be part of the target circuit, powered by VDD_INT. In other embodiments, the predictive control 87*b* may be powered by the external power supply VDD_EXT, or otherwise.

The predictive control 87*b* generates control signals EN0 to EN5 in this example, on line 88, which are used to control the current loading circuits. The current loading circuits include a plurality of load elements (six in this example), each having a switch (transistors 93, 94, . . . 95) controlled by a corresponding one of the control signals EN0 to EN5, and a circuit element including in this example passive resistors 90, 91, . . . 92. The load elements in this example are resistive circuits, having low capacitance. The load elements are connected in series between ground and the output node 86 in the embodiment illustrated, and can be used to selectively add current load to the output node 86 according to a pattern determined by the control signals EN0 to EN5. The resistors 90, 91, . . . 92 in this embodiment can all have the same resistance, so that the load elements provide equal current loading, or the resistors 90, 91, . . . 92 can vary in size for more precise or complex control of the current loading. In other embodiments, the load in the load elements can comprise other types of elements besides or in addition to passive resistors 90, 91, . . . 92, such as MOS transistors or other circuit elements or circuits, such as current mirror circuits, that act as a current sink that loads the voltage regulator output.

Operation of the circuit of FIG. 3 is described with reference to the timing diagram shown in FIG. 4. The timing diagram in FIG. 4 includes the timing of the logic signals C1 (not shown in FIG. 3) and EN0 to EN5, in the lower chart, and the total current on the output node 86 versus time in the upper chart.

In this example, the control signal C1 corresponds to a mode control signal for the system circuits 87*a*, defining an event at a first time corresponding to a first transition at which the current loading drawn by the system circuits rapidly increases at the beginning, and rapidly decreases at a second time corresponding to a second transition. The interval between the first time and the second time is the operating interval 98 in FIG. 4.

The control signals EN0 to EN5 are coupled to the switches in the current loading elements shown in FIG. 3. The logic in the predictive control 87*b* is coupled to the switches in the plurality of load elements, and opens and closes the switches in a pattern during the pre-loading interval and during the post-loading interval that is configured to induce current loading in a manner to balance transitions in the target circuit, and that prevents or eliminates spikes and fluctuations including overshoots and undershoots, thereby stabilizing the output of the voltage regulator on node 86.

In the example of FIG. 3, each of the current load elements applies an identical amount of current loading when connected to the output node 86. Thus, control signals EN0 to EN5 can be turned on in sequence as illustrated in FIG. 4, to cause in turn equal steps in magnitude of the current on the output node 86. In this example, a background current load of 10 mA is drawn on the output node 86 when the system circuits are in an idle mode or in a standard operating mode. Upon occurrence of the mode change, the current load can increase for example to 80 mA very rapidly. Thus, by applying increases of current loading in a sequence of steps, this transition can be reduced or eliminated. In this example, starting at 10 mA, six steps of about 11.5 mA of current loading results in a maximum current loading delivered by the predictive loading circuits of 70 mA which, when combined with the idle current in the target circuit, results in a total of 80 mA being sinked at the end of the pre-loading interval, before the transition in the target circuit.

Figure 4:
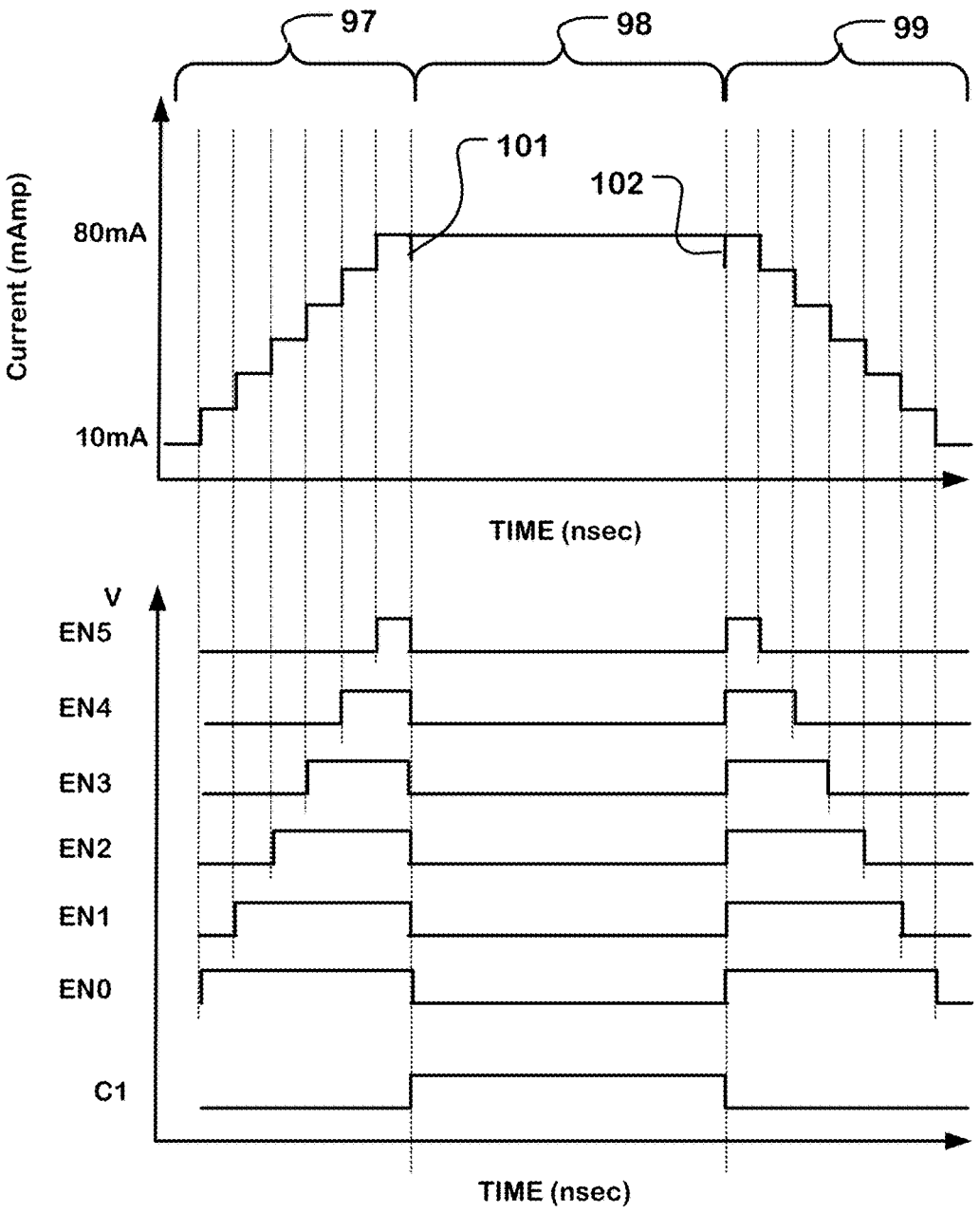
FIG. 4 is a timing diagram referred to for the purposes of describing operation of the circuit of FIG. 3.

As illustrated in FIG. 4, the control signals EN0 to EN5 can be turned off in a synchronized manner upon occurrence of the event at the first transition of C1 when the current loading of the system circuits rapidly increases, where the increase in this example is from 10 mA to 80 mA upon occurrence of the event. As a result, a changeover indicated by line 101 of current loading from the current loading circuit to current loading by the system circuits occurs upon occurrence of the event indicated by the first transition in the control signal C1.

Upon the second transition of C1, when the current loading of the system circuits rapidly decreases, the control signals EN0 to EN5 can be turned on in a synchronized manner. As a result, 70 mA of current loading is added to the output node 86, for a total of 80 mA of current loading when combined with the 10 mA background current loading of the system circuits. Therefore, the increase in current loading in the target circuit in response to the event has a magnitude about equal to a maximum current load applied during the pre-loading interval 97 by the current loading circuit. In this case, the changeover 101 does not cause a large fluctuation in load on the voltage regulator, and helps stabilize the voltage on the output node 86.

As a result, a changeover indicated by the line 102, of the current loading from the system circuits to the current loading circuit occurs upon occurrence of the event indicated by the second transition of the control signal C1. Therefore, the decrease in current loading in the target circuit in response to the event has a magnitude about equal to a maximum current load applied during the post-loading interval 99 by the current loading circuit. In this case, the changeover 102 does not cause a large fluctuation in load on the voltage regulator, and helps stabilize the voltage on the output node 86.

In the embodiments illustrated in FIG. 2 and FIG. 4, the magnitude of the current loading applied by the current loading circuit during the pre-loading interval increases monotonically from a starting load to a maximum load. Likewise, the magnitude of the current loading applied by the current loading circuit during the post-loading interval decreases monotonically from a maximum load to an ending load which can be a minimum current loading that can be applied by the current loading circuit or zero current loading.

In general, the circuit shown in FIG. 3 is an example that comprises an LDO voltage regulator supplying a regulated voltage on an output node. A current loading circuit is connected to the output node of the LDO voltage regulator. Logic is applied to cause the current loading circuit to apply a first current load to the output node during a pre-loading interval, starting in advance of a first event that increases current loading in the target circuit, and ending upon the occurrence of, or synchronized with, the first event. Also, the logic causes the current loading circuit to apply a second current load to the output node during a post-loading interval that starts upon the occurrence of, or synchronized with, a second event that decreases current loading in the target circuit. The logic is configured to increase current loading applied by the current loading circuit according to a first pattern during the pre-loading interval so that a rapid transition in current loading on the output node (i.e. the sum of current loading of circuits powered by the regulated voltage) upon occurrence of the event and changeover from the current loading circuit to the target circuit, is less than to the increase in current loading in the target circuit upon occurrence of the first event, and preferably close to zero. Also, the logic is configured to decrease current loading by applying the current loading circuit according to a second pattern during the post-loading interval so that a rapid transition in current loading on the output node (i.e. the sum of current loading of circuits powered by the regulated voltage) upon occurrence of the second event is less than the decrease in current loading in the target circuit upon occurrence of the second event, and preferably close to zero.

In preferred embodiments, the circuits are designed to specifications that set the changeovers 101, 102 where the difference in current loading by the predictive current loading circuit and current loading in the operating intervals by the target circuit are zero or close to zero.

For the purposes of this description, the current loading is applied "upon occurrence of an event" when it is applied on a timescale corresponding to the transient response of the voltage regulator, so that fluctuations in the regulated voltage as a result of the changes in loading current in the target circuits are reduced or eliminated. For the purposes of this description, an event is synchronized with another event when its timing is dependent on said other event, such as when controlled by a transition of a common logic signal or clock signal.

Technology is described for producing a regulated voltage for circuits having fast changes in current loading, that includes predictive circuits to reshape the total output current sink from the regulator, so that the regulated voltage will have a more stable value.

Embodiments are described based on square-wave type current loading by the target circuits. The technology can be applied to more complex systems, where transitions in current loading are predicted, and balanced by pre-loading, post-loading or both.

The embodiment of FIG. 3 uses an LDO with an n-channel power transistor 81. In alternative embodiments, an LDO with a p-channel power transistor can be used.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A device which supplies a regulated voltage to a target circuit characterized by fast changes in current loading, comprising:

a voltage regulator to supply the regulated voltage on an output node;

a current loading circuit connected to the output node of the voltage regulator; and logic responsive to control signals predictive of change in current loading by the target circuit, to cause the current loading circuit to apply a current load to the output node starting in advance of an event that increases current loading in the target circuit and ending upon occurrence of the event.

2. The device of claim 1, wherein the increase in current loading in the target circuit in response to the event has a magnitude about equal to a maximum current load applied in advance by the current loading circuit.

3. The device of claim 2, wherein the current loading circuit monotonically increases the current load it applies in advance.

4. The device of claim 2, wherein the current loading circuit comprises a plurality of load elements, each having a switch, and the logic is coupled to the switches of the plurality of load elements, and opens and closes the switches in a pattern to apply a current load.

5. The device of claim 1, including logic to cause the current loading circuit to apply a current load to the output node starting upon occurrence of an event that decreases current loading in the target circuit.

6. The device of claim 5, wherein the decrease in current loading in the target circuit upon occurrence of the event has a magnitude about equal to a maximum current load applied after the event causing the decrease by the current loading circuit.

7. The device of claim 6, wherein the current loading circuit monotonically decreases the current load it applies after the event causing the decrease.

8. The device of claim 6, wherein the current loading circuit comprises a plurality of load elements, each having a switch, and the logic is coupled to the switches of the plurality of load elements, and opens and closes the switches in a pattern in advance of the event causing the increase and after the event causing the decrease.

9. The device of claim 1, wherein the voltage regulator comprises a low drop out (LDO) regulator.

10. The device of claim 1, wherein the voltage regulator comprises a transistor having a gate, a first terminal connected to a power supply terminal, a second terminal connected to the output node, an amplifier having an output connected to the gate of the transistor, and a feedback circuit between the output node and an input of the amplifier.

11. A device which supplies a regulated voltage to a target circuit characterized by fast changes in current loading, comprising:

a low drop out (LDO) voltage regulator to supply the regulated voltage on an output node;

a current loading circuit connected to the output node of the LDO voltage regulator; and logic to cause the current loading circuit to apply a first current load to the output node during a pre-loading interval starting in advance of a first event that increases current loading in the target circuit and ending synchronized with the first event, and to cause the current loading circuit to apply a second current load to the output node during a post-loading interval starting synchronized with a second event that decreases current loading in the target circuit, wherein:

the logic is configured to increase current loading applied by the current loading circuit according to a first pattern during the pre-loading interval so that a transition in current loading on the output node upon occurrence of the first event is less than the increase in current loading in the target circuit upon occurrence of the first event, and to decrease current loading applied by the current loading circuit according to a second pattern during the post-loading interval so that a transition in current loading on the output node upon occurrence of the second event is less than the decrease in current loading in the target circuit upon occurrence of the second event.

12. The device of claim 11, wherein the current loading circuit comprises a plurality of load elements, each having a switch, and the logic is coupled to the switches of the plurality of load elements, and opens and closes the switches in the first and second patterns during the pre-loading interval and during the post-loading interval respectively.

13. A method for supplying a regulated voltage to a target circuit characterized by fast changes in current loading, comprising:

receiving in a logic circuit a control signal predictive of changes in loading in the target circuit;

supplying the regulated voltage on an output node coupled to the target circuit; and applying, in response to output of the logic circuit responsive to the control signal, a current load to the output node in advance of an event that increases current loading in the target circuit and ending upon occurrence of the event.

14. The method of claim 13, including applying a current load to the output node upon occurrence of an event that decreases current loading in the target circuit.

15. The method of claim 13, wherein said supplying the regulated voltage includes using a low drop out (LDO) regulator.

* * * * *